US010125790B2

(12) United States Patent
Pettitt

(10) Patent No.: US 10,125,790 B2
(45) Date of Patent: Nov. 13, 2018

(54) CENTRIFUGAL FAN WITH REDUCED MOTOR COOLING NOISE

(71) Applicant: MAHLE International GmbH, Stuttgart (DE)

(72) Inventor: Edward D. Pettitt, Newfane, NY (US)

(73) Assignee: MAHLE International GmbH, Stuttgart (DE)

( * ) Notice: Subject to any disclaimer, the term of this patent is extended or adjusted under 35 U.S.C. 154(b) by 319 days.

(21) Appl. No.: 14/339,629

(22) Filed: Jul. 24, 2014

(65) Prior Publication Data

US 2016/0025107 A1 Jan. 28, 2016

(51) Int. Cl.

| | |
|---|---|
| ***F04D 29/58*** | (2006.01) |
| ***F04D 29/32*** | (2006.01) |
| ***F04D 29/22*** | (2006.01) |
| ***F04D 29/26*** | (2006.01) |
| ***F04D 17/16*** | (2006.01) |
| ***F04D 25/08*** | (2006.01) |
| ***F04D 29/28*** | (2006.01) |
| ***F04D 17/10*** | (2006.01) |
| *F04D 29/66* | (2006.01) |

(52) U.S. Cl.

CPC ..... *F04D 29/5806* (2013.01); *F04D 17/10* (2013.01); *F04D 17/16* (2013.01); *F04D 25/082* (2013.01); *F04D 29/22* (2013.01); *F04D 29/2211* (2013.01); *F04D 29/2216* (2013.01); *F04D 29/263* (2013.01); *F04D 29/281* (2013.01); *F04D 29/329* (2013.01); *F04D 29/663* (2013.01)

(58) Field of Classification Search

CPC .... F04D 29/5806; F04D 17/10; F04D 29/663; F04D 29/054; F04D 29/281; F04D 29/667; F04D 29/4226; F04D 25/08; F04D 29/4233; F04D 29/239; F04D 29/283; F04D 29/2211; F04D 29/2216; F04D 25/082; F04D 29/32; F04D 29/329; F04D 29/325; F04D 29/326; A61M 16/0066; A61M 2205/42

USPC ..... 416/215–218, 93 R, 181; 415/119, 106; 310/62, 64, 51

See application file for complete search history.

(56) References Cited

U.S. PATENT DOCUMENTS 2,418,221 A * 4/1947 Curtis ..... F04D 9/002 222/241
3,363,832 A * 1/1968 Groff ..... F04D 29/281 415/119
4,583,911 A * 4/1986 Braun ..... F04D 29/681 415/116

(Continued)

FOREIGN PATENT DOCUMENTS

JP 2015059504 A * 3/2015 ..... F04B 39/066
WO WO 2011017763 A1 * 2/2011 ..... A61M 16/0066

*Primary Examiner* — Charles Freay
(74) *Attorney, Agent, or Firm* — Brinks Gilson & Lione

(57) ABSTRACT

A blower assembly suitable for use in a vehicle heating, ventilation, and air conditioning (HVAC) system includes a motor and a fan. The motor is configured to define an exit region where air that flows through the motor exits the motor. The centrifugal fan is configured to attach to a shaft of the motor. The fan defines a plurality of passageways configured to allow the air from the motor to pass through the fan. The passageways are configured to minimize noise caused by the air drawn through the motor.

4 Claims, 2 Drawing Sheets

(56) References Cited

U.S. PATENT DOCUMENTS

| | | | | |
|---|---|---|---|---|
| 5,478,201 | A * | 12/1995 | Amr | F04D 17/16 415/119 |
| 6,034,451 | A * | 3/2000 | El Mayas | F04D 25/082 310/58 |
| 2006/0265833 | A1* | 11/2006 | Cobb, Jr. | F04D 29/281 15/344 |
| 2008/0286093 | A1* | 11/2008 | Bauer, Jr. | F04D 29/263 415/146 |
| 2012/0138058 | A1* | 6/2012 | Fu | A61M 16/0066 128/204.23 |
| 2012/0171026 | A1* | 7/2012 | Ohtsuka | F04D 29/281 415/206 |
| 2013/0156554 | A1 | 6/2013 | Thawani et al. | |
| 2015/0078938 | A1* | 3/2015 | Ichihashi | F04B 39/066 417/423.8 |

* cited by examiner

CENTRIFUGAL FAN WITH REDUCED MOTOR COOLING NOISE

TECHNICAL FIELD OF INVENTION

This disclosure generally relates to a centrifugal fan, and more particularly relates to cooling passageways or slots arranged about the hub of the fan to allow cooling air to pass through the motor driving the fan without producing excessive noise.

BACKGROUND OF INVENTION

Electric motors used to power blowers in Automotive Heating, Ventilation, and Air Conditioning (HVAC) systems benefit from cooling air flow directed through the motor itself. It is known to provide circular holes in the dome or hub portion of a centrifugal fan to allow cooling air to pass through the electric motor driving the fan. This cooling air flows internally through the motor to remove heat generated by brushes, coils, and/or electronic control elements so that the motor runs efficiently and with reduced degradation. However, circular holes often create a noise which has a frequency related to the number of holes as they pass a high pressure area developed at the inlet area of the fan. The noise can propagate through the HVAC system as noise heard by a person such as a passenger in an automobile. It is therefore desirable to have openings in the fan for cooling the motor that do not cause noise.

SUMMARY OF THE INVENTION

In accordance with one embodiment, a centrifugal fan suitable for use in a vehicle heating, ventilation, and air conditioning (HVAC) system is provided. The fan includes a hub, a plurality of fan blades, and a plurality of passageways. The hub is configured to define an opening suitable to receive a shaft of a motor. The plurality of fan blades is arranged about a perimeter of the hub. The plurality of passageways is arranged about the hub between the opening and the perimeter to allow air to pass through the motor. The passageways are configured to minimize noise caused by the air drawn through the motor.

In another embodiment, a blower assembly suitable for use in a vehicle heating, ventilation, and air conditioning (HVAC) system is provided. The assembly includes a motor and a fan. The motor is configured to define an exit region where air that flows through the motor exits the motor. The centrifugal fan is configured to attach to a shaft of the motor. The fan defines a plurality of passageways configured to allow the air from the motor to pass through the fan. The passageways are configured to minimize noise caused by the air drawn through the motor.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
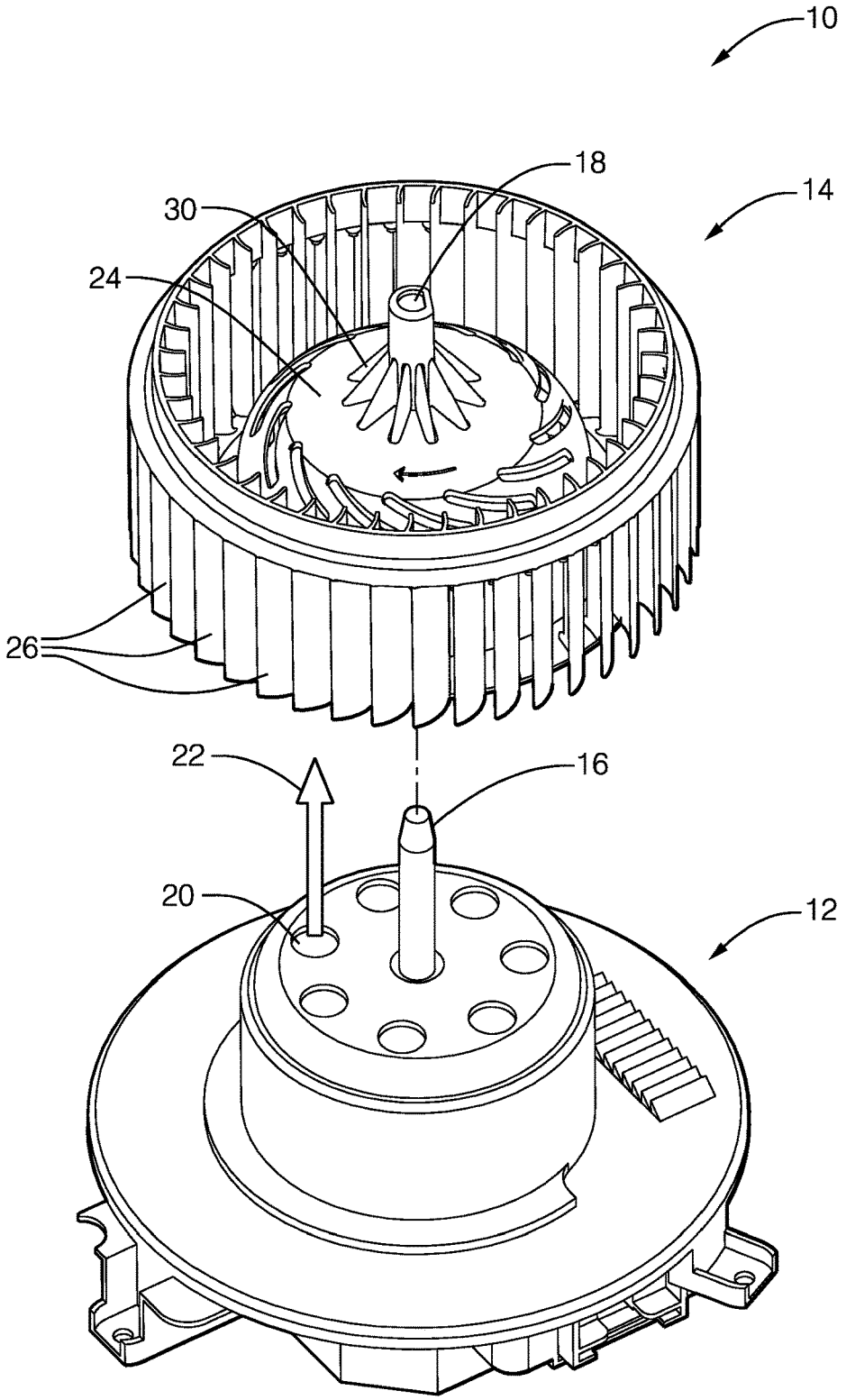
FIG. 1 is an exploded view of a blower assembly in accordance with one embodiment.

FIG. 1 illustrates a non-limiting example of an exploded view of a blower assembly, hereafter referred to as the assembly 10. The assembly 10 includes a motor 12 and a centrifugal fan, hereafter referred to as the fan 14. The assembly 10 is generally formed when a shaft 16 is inserted or pressed into an opening 18 from the underside (opposite the side shown) of the fan 14. While the opening 18 is illustrated in this example as a through-hole, it is contemplated that the end of the opening 18 may be a closed-end or blind-hole configuration so the distance that the shaft 16 can be inserted into the opening 18 has a definite limit. The shaft 16 and the opening 18 are illustrated as having a 'D' shape, but other configurations are contemplated such as a star shape or a knurled surface on the end of the shaft 16.

FIG. 1 illustrates the motor 12 and the fan 14 as spaced apart only for the purpose of clear illustration of features of the motor 12. It should be understood that the assembly 10 is formed when the motor 12 and the fan 14 are assembled together such that some of the features of the motor 12 would not be clearly visible. In general, the assembly 10 is suitable for use in a vehicle heating, ventilation, and air conditioning (HVAC) system (not shown). However, it is contemplated that the improvements described herein could be applied to any HVAC system, blower assembly, or centrifugal fan use in, for example, a building.

The motor 12 is generally configured to define an exit region 20 where air 22 that flows through the motor 12 exits the motor 12. It is advantageous for the air 22 to flow through the motor 12 to cool various parts of the motor 12 such as bushings and bearings. Lower operating temperatures of these and other parts of the motor 12 generally extends the operating life of the motor 12. While the exit region 20 is illustrated as a circular hole, and the arrangement of the plurality of circular holes illustrated may also be part also part of the exit region 20, it is recognized that other configurations of exit regions with different shaped holes are possible.

Figure 2:
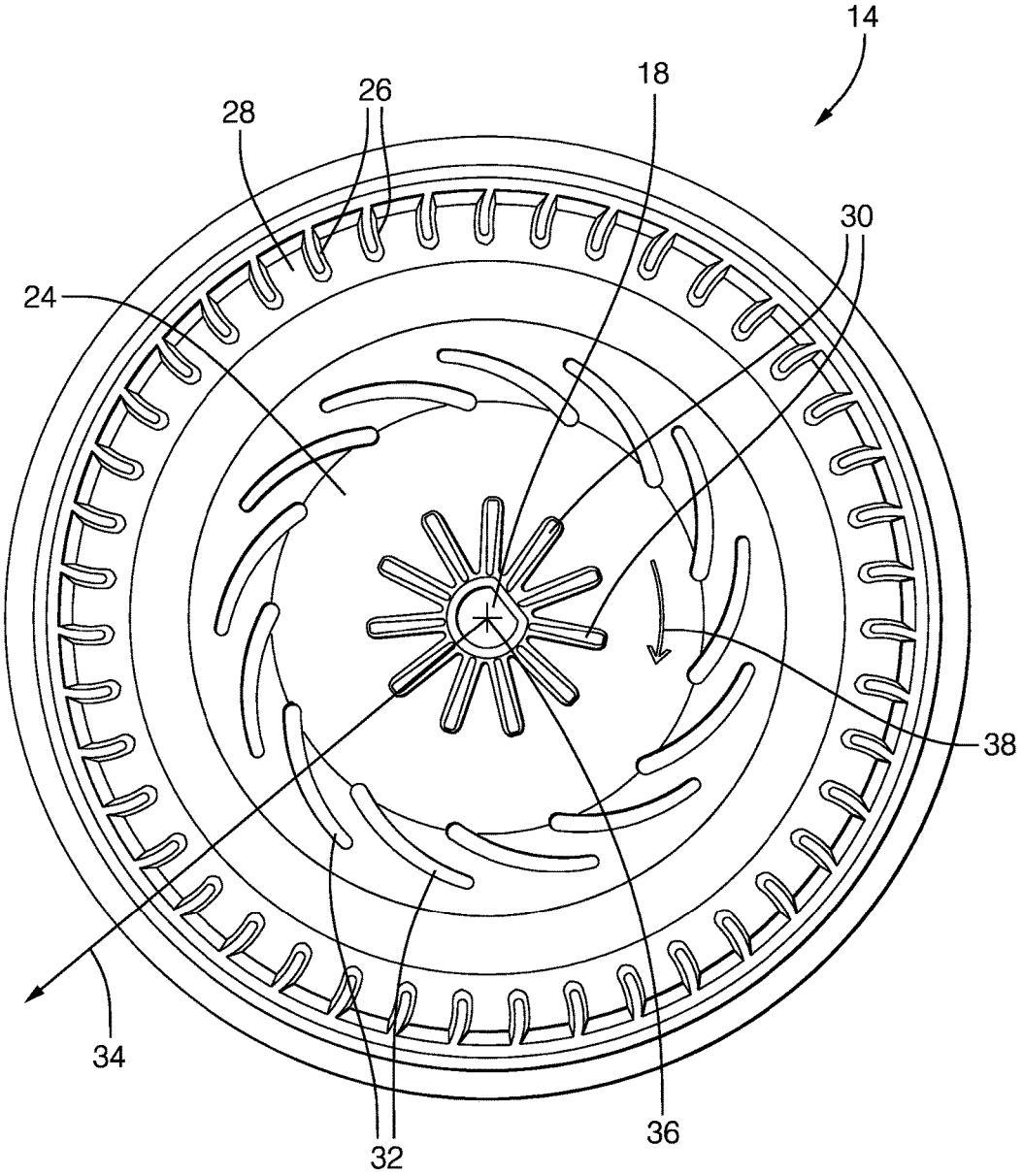
FIG. 2 is an end view of a fan used in the assembly of FIG. 1 in accordance with one embodiment.

FIG. 2 further illustrates non-limiting features of the fan 14. The fan 14 includes a hub 24 that is generally configured to define the opening 18 previously described. The fan 14 also includes a plurality of fan blades 26 arranged about a perimeter 28 of the hub 24. By way of example and not limitation, a suitable diameter of the perimeter 28 for an automotive application is one-hundred-fifty millimeters (150 mm). The fan 14 may be advantageously formed of a polymeric compound so that the fan 14 may be formed using known injection molding processes. Alternatively, the fan 14 may be formed of several metal parts that may be stamped, formed, and attached together using process well known to those in the fan assembly arts. If the hub 24 or the entirety of the fan 14 is formed of a polymeric compound, the hub 24 may also be configured to define reinforcement features 30 to reinforce the coupling of the fan 14 to the motor 12. If the hub 24 is formed of metal, such reinforcement may not be necessary.

The fan 14 also includes a plurality of passageways 32 arranged about the hub 24 between the opening 18 and the perimeter 28 to allow the air 22 that passed through the motor 12 to also pass through the fan 14. A prior attempt to provide for the passage of cooling air from a motor through a centrifugal type fan used a plurality of circular holes arranged about the hub of the fan. The circular holes were all located at the same distance or radius from the center of the hub. It was observed that the plurality of circular holes generated an undesirable amount of noise when passing cooling air from a motor similar to that shown in FIG. 1. While not subscribing to any particular theory, it is believed that the arrangement of circular holes caused an on-off-on variation of flow of air through the motor that resulted from the circular hole followed by a solid web section passing through a pressure difference between the exit region 20 and the side of the hub viewed in FIG. 2. The circular hole would allow flow causing a reduction in pressure difference while the solid web would block flow causing an increase pressure difference. This would create a variable pressure wave perceptible as noise. The frequency of the noise is determined by the number of holes (order) combined with the speed of rotation, and the resulting tonal noise was easily heard.

In order to reduce the noise, the passageways 32 describe herein are configured to minimize noise caused by the air 22 drawn through the motor 12. That is, the passageways are configured to minimize the variation in pressure caused by the passing of the passageways 32 over the exit region 20. Again, while not subscribing to any particular theory, it is believed that the passageways 32 should generally be configured so there is always some portion of at least one of the passageways overlying any portion of the exit region 20. As such, the fan 14 defines a plurality of passageways 32 configured to allow the air 22 from the motor 12 to pass through the fan 14, where the passageways 32 are configured to minimize noise caused by the air 22 drawn through the motor 12.

By way of further explanation, if a radial vector or radial line 34 is drawn that originates at a center 36 of the hub 24 and is held stationary as the fan 14 rotates underneath it, the arrangement of the passageways 32 is such that there is always a slot under the radial line 34. As one passageway is exiting or passing by the radial line 34, the next or adjacent passageway is already under radial line 34. This is intended to prevent a break in the flow of the air 22.

Continuing to refer to FIG. 2, each of the passageways 32 may be characterized as a slot that is angled relative to the radial line 34 which originates at the hub 24. The slots are illustrated as angled to form an inward spiral relative to the preferred direction of fan rotation indicated by the fan rotation direction arrow 38, but the slots could be angled in the other direction. Each slot is illustrated to have a relatively constant width. However, passageways with other shapes and slots with varying width are also contemplated. The slots are angled relative to the radial line 34 in order to create the structural web between overlapping slots. The structural web connects the shaft portion of the hub that defines the opening 18 to the lower or outer portion of the hub 24 that carries the fan blades 26. The thickness and width of the web along with the properties of the material of which the fan is constructed will determine the strength of the web. The angled slot is preferred as there is less chance that a narrow band of pressure differential can occur and cause an intermittent pressure pulsation that would create noise.

In this non-limiting example, each slot may be characterized as curved. A curved shape is believed to be advantageous over a relatively strait slot because curved slots allow the desired length of slot to be provided within a shorter diametrical zone of the fan hub. The fan hub topography is somewhat like a hill which is steeper further from its peak. So a molding detail to create the slot width will create an open area closer to the planar or projected shape where the topography is less steep.

In some instances, balance clips (not shown, little metal spring clips that press onto the fan blade) may be added at the appropriate location to balance the fan 14. In order to prevent a dropped clip from falling through the slot and into the motor 12, the width of the slot may be selected to be less than the minimum dimension of a balance clip.

As mentioned above, the passageways 32 may be arranged such that at least one passageway intersects any radial line originated at the hub. Instead of aligning a leading edge of one passageway with a trailing edge of a passageway, it was discovered through empirical testing that noise could be further reduced if adjacent passageways are arranged to overlap the radial line 34 as illustrated. The optimum amount of overlap generally depends on the pressure difference on the opposing sides of the hub 24, the amount of restriction of the HVAC system, and the shape of the passageways 32. In most instances where the passageways 32 are slots, some overlap provides for the least noise, but some fan configurations may tolerate zero overlap where one slot starts at the same radial line as one ends. In general, a combination of testing and computer modeling is used to optimize the amount of overlap.

The number of the passageways 32 may be varied, and depending on the design of the motor 12, it may be advantageous if the number is a prime number. For example, if the fan 14 has twelve passageways or slots, and the fan 14 rotates at 1000 revolutions per minute (RPM), the frequency generated would be 12 slots/rev*1000 Rev/min*1 min/60 sec=200 Hz. 200 Hz would be the base frequency. But 12 is divisible by 2, 3, 4 & 6 so there could be noise at harmonic frequencies of 33 Hz, 50 Hz, 67 Hz, & 100 Hz respectively. There can also be multiples of the base frequencies and its sub-harmonics as well. As such, the noise may include frequencies that could excite cavity resonances or structural resonance in the HVAC system that could amplify the noise. With a prime number of slots, e.g. 13, the base frequency is 216 Hz for rotation at 1000 RPM, and the next harmonic is double that at 432 Hz.

While the spacing of the passageways 32 (i.e. slots) is illustrated as being relatively uniform, it is recognized that there may be some benefit realized by randomizing the spacing of the slots as well as widths. A disadvantage of doing so can be that balancing the fan 14 by adding balancing clips may be more complicated and time consuming. It is noted that prior to conceiving the idea of overlapping the slots, several options of irregular shaped passageways and irregularly spaced holes were tested, without substantive success. For the configuration of the motor 12 illustrates, the best test results were realized by the overlapping curved slots illustrated in FIGS. 1 and 2.

Accordingly, a blower assembly (the assembly 10) and a fan 14 are provided. In general, increased noise is created by the alternating open-close or solid-open sections as they pass through a high pressure region proximate to the hub 24, thus creating peak pressure fluctuation. In order to provide cooling with minimum noise, the assembly 10 and the fan 14 described herein attempts to provide a relatively continuous opening relative to the passage through the high pressure area while at the same time maintaining structural connections between the fan blades and the shaft 16 of the motor 12. This is achieved by creating slots that are angled such that they are contiguous or slightly overlapping while creating a structural web connecting the upper and lower portion of the fan as shown in FIGS. 1 and 2.

While this invention has been described in terms of the preferred embodiments thereof, it is not intended to be so limited, but rather only to the extent set forth in the claims that follow.

I claim:

1. A centrifugal fan suitable for use in a vehicle heating, ventilation, and air conditioning (HVAC) system, said fan comprising:

a hub surrounding an opening suitable to receive a shaft of a motor defining an axial direction;

a plurality of fan blades arranged radially outside of a perimeter of the hub; and a plurality of passageways extending axially through the hub between the opening and the perimeter to allow air to pass through the motor, wherein the passageways are configured to minimize noise caused by the air drawn through the motor, and wherein each one of the plurality of passageways overlaps with an adjacent one of the plurality of passageways at a radial line originating at the opening, wherein each of the passageways is a slot that is angled relative to a radial direction and has a constant width.

2. The fan in accordance with claim 1, wherein the slot is curved.

3. The fan in accordance with claim 1, wherein the fan includes a prime number of the passageways.

4. A blower assembly suitable for use in a vehicle heating, ventilation, and air conditioning (HVAC) system, said assembly comprising:

a motor configured to define an exit region where air that flows through the motor exits the motor; and a centrifugal fan configured to attach to a shaft of the motor, wherein the fan has a hub with a plurality of passageways extending through the hub and allowing the air from the motor to pass through the hub, wherein the passageways are configured to minimize noise caused by the air drawn through the motor, wherein each one of the plurality of passageways overlaps with an adjacent one of the plurality of passageways at a radial line originating at the opening, wherein each of the passageways is a slot that is angled relative to a radial direction and has a constant width.

* * * * *